US012025356B2

(12) United States Patent
Tanaka

(10) Patent No.: US 12,025,356 B2
(45) Date of Patent: Jul. 2, 2024

(54) OIL SUPPLY SYSTEM FOR COMPRESSOR

(71) Applicant: MAYEKAWA MFG. CO., LTD., Tokyo (JP)

(72) Inventor: Kiyoshi Tanaka, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 239 days.

(21) Appl. No.: 17/774,890

(22) PCT Filed: Nov. 26, 2020

(86) PCT No.: PCT/JP2020/043970

§ 371 (c)(1),
(2) Date: May 6, 2022

(87) PCT Pub. No.: WO2021/106989

PCT Pub. Date: Jun. 3, 2021

(65) Prior Publication Data

US 2022/0390157 A1 Dec. 8, 2022

(30) Foreign Application Priority Data

Nov. 28, 2019 (WO) ..... PCT/JP2019/046580

(51) Int. Cl.

| | |
|---|---|
| ***F25B 43/02*** | (2006.01) |
| ***F04C 29/02*** | (2006.01) |
| ***F25B 31/00*** | (2006.01) |
| ***F25B 49/00*** | (2006.01) |
| ***F25B 49/02*** | (2006.01) |

(52) U.S. Cl.

CPC ..... *F25B 43/02* (2013.01); *F04C 29/025* (2013.01); *F25B 31/004* (2013.01); *F25B 49/02* (2013.01); *F25B 2700/03* (2013.01)

(58) Field of Classification Search

CPC ..... F25B 43/02; F25B 31/004; F04C 29/025
See application file for complete search history.

(56) References Cited

U.S. PATENT DOCUMENTS 2,760,936 A * 8/1956 Baker ..... C10M 5/00 508/539
5,765,392 A 6/1998 Baur
(Continued)

FOREIGN PATENT DOCUMENTS

JP S5228714 U 2/1977
JP S53013653 U 2/1978
(Continued)

OTHER PUBLICATIONS

English KR20140096444 by PE2E Feb. 23, 2023.*
(Continued)

*Primary Examiner* — Deming Wan
(74) *Attorney, Agent, or Firm* — ROSSI, KIMMS & McDOWELL LLP

(57) ABSTRACT

An oil supply system for a compressor according to an embodiment includes an oil separator connected to a discharge pipe of the compressor, an oil tank for receiving oil from an oil sump of the oil separator, an oil pipe disposed between the oil separator and the oil tank, a pressure reducing valve disposed on the oil pipe, an oil supply pipe for supplying the oil to an oil line for supplying the oil to the compressor from an oil sump of the oil tank, and an agitator disposed on the oil pipe.

16 Claims, 8 Drawing Sheets

(56) References Cited

U.S. PATENT DOCUMENTS

| | | | | |
|---|---|---|---|---|
| 7,347,301 | B2 | 3/2008 | Sekiya et al. | |
| 2011/0284671 | A1* | 11/2011 | Yamamoto | C10G 1/045 241/23 |
| 2018/0023571 | A1* | 1/2018 | Endo | F04C 18/16 418/202 |

FOREIGN PATENT DOCUMENTS

| | | | | |
|---|---|---|---|---|
| JP | 2003286982 | A | 10/2003 | |
| JP | 4268251 | B2 | 5/2009 | |
| JP | 4588708 | B2 | 12/2010 | |
| JP | 2016161211 | A | 9/2016 | |
| KR | 20140096444 | A * | 1/2013 | B01D 5/00 |

OTHER PUBLICATIONS

International Search Report issued in International Application No. PCT/JP2020/043970 mailed Feb. 2, 2021. English translation provided.

Written Opinion issued in International Application No. PCT/JP2020/043970 mailed Feb. 2, 2021.

International Search Report issued in International Application No. PCT/JP2019/046580 mailed Feb. 18, 2020. English translation provided.

Written Opinion issued in International Application No. PCT/JP2019/046580 mailed Feb. 18, 2020.

International Preliminary Report on Patentability issued in International Application No. PCT/JP2020/043970 mailed Jun. 9, 2022. English translation provided.

English translation of Written Opinion issued in International Application No. PCT/JP2020/043970 mailed Feb. 2, 2021, previously cited in IDS filed May 6, 2022.

International Preliminary Report on Patentability issued in International Application No. PCT/JP2019/046580 mailed Jun. 9, 2022. English translation provided.

English translation of Written Opinion issued in International Application No. PCT/JP2019/046580 mailed Feb. 18, 2020, previously cited in IDS filed May 6, 2022.

* cited by examiner

OIL SUPPLY SYSTEM FOR COMPRESSOR

TECHNICAL FIELD

The present disclosure relates to an oil supply system for a compressor.

BACKGROUND

An oil injection type compressor, such as a screw compressor, is equipped with an oil supply system for supplying oil to a compression space, a bearing, and the like. After the oil supplied to the compression space is discharged from the compressor along with a compressed gas, the oil is separated from the compressed gas by an oil separator and returned to the compressor again. The oil separated from the compressed gas in the oil separator has a low viscosity due to a dissolved component of the compressed gas. Therefore, if the oil with the decreased viscosity is directly supplied to a bearing and a mechanical seal, a lubricant function and a sealing function may be degraded. As a countermeasure to the above problem, there is a method for using high-viscosity oil to compensate for the decrease in viscosity. However, at the stage where the compressed gas has not yet dissolved and has a low temperature, such as during startup, the viscosity is higher than the appropriate viscosity, which may result in poor lubricant of the bearing or seal failure or the like, or may increase a starting torque of the compressor, resulting in a startup failure.

Patent Document 1 describes a screw compressor where a pressure reducing mechanism is installed in an interconnection pipe for transferring oil, which is separated from a refrigerant (compressed gas) by an oil separator, from an oil sump portion formed at the bottom of the oil separator to a closed vessel, and a pressure of the closed vessel is changed by control of the pressure reducing mechanism to increase/decrease a vaporization amount of the refrigerant dissolved in the oil in the closed vessel, thereby regulating the temperature of the oil supplied to the compressor.

CITATION LIST

Patent Literature

Patent Document 1: Specification and drawings of Japanese Utility Model Application No. S51-95349 (Japanese Unexamined Utility Model Application Publication No. S53-13653)

SUMMARY

Technical Problem

In the screw compressor described in Patent Document 1, the pressure reducing mechanism controls a vapor-liquid equilibrium state in the closed vessel to vaporize the refrigerant dissolved in the oil. In this case, if a retention time of the oil in the closed vessel is short, the oil may be discharged from the closed vessel without sufficient vaporization of the refrigerant in the closed vessel. The vaporization rate of the refrigerant can be improved by increasing the size of the closed vessel and prolonging the retention time of the oil in the closed vessel. However, actual equipment generally has space constraints and cannot prolong the retention time in terms of operating efficiency of the equipment.

The present disclosure was made in view of the above, and an object of the present disclosure is to propose an oil supply system capable of decreasing the amount of the dissolved compressed gas which is contained in the oil supplied to each portion of the compressor in a short time.

Solution to Problem

An oil supply system for a compressor according to the present disclosure includes an oil separator connected to a discharge pipe of the compressor, an oil tank for receiving oil from an oil sump of the oil separator, an oil pipe disposed between the oil separator and the oil tank, a pressure reducing valve disposed on the oil pipe, an oil supply pipe for supplying the oil to an oil line for supplying the oil to the compressor from an oil sump of the oil tank, and an agitator disposed on the oil pipe.

Advantageous Effects

With an oil supply system for a compressor according to the present disclosure, it is possible to promote separation of a compressed gas dissolved in oil, in an oil pipe disposed between an oil separator and an oil tank. Thus, highly-efficient degassing of the compressed gas from the oil in the oil tank is possible, making it possible to supply the oil, where the amount of the dissolved compressed gas is small and a viscosity is not decreased, to the compressor. Therefore, it is possible to sufficiently maintain a lubricant function in a bearing, a seal portion, and the like of the compressor. Further, even if a retention time of the oil in the oil tank is relatively short, or even if the volume of the oil tank is small, the compressed gas can be degassed from the oil with high efficiency, making it possible to efficiently operate the oil supply system, as well as to reduce the size of the oil tank.

DETAILED DESCRIPTION

Figure 1:
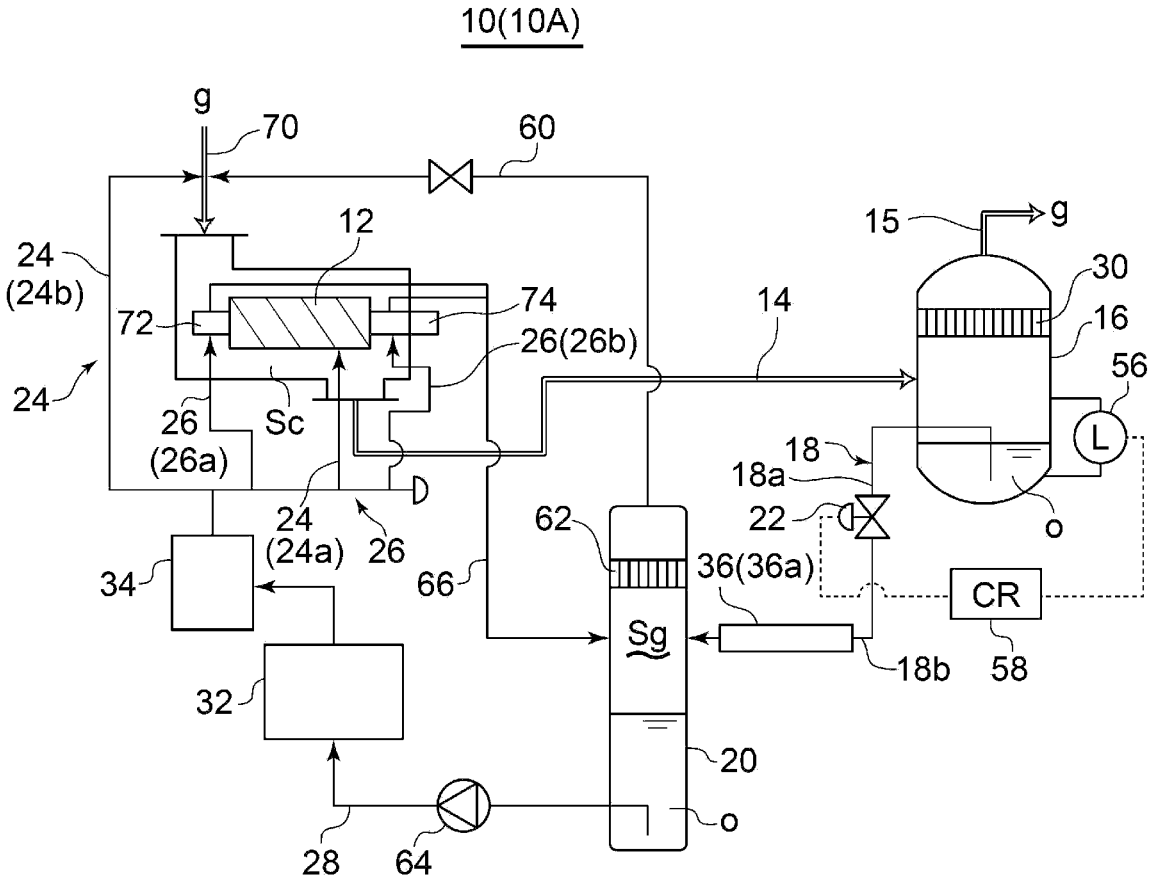
FIG. 1 is a system diagram of an oil supply system for a compressor according to an embodiment.

Some embodiments of the present invention will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 2:
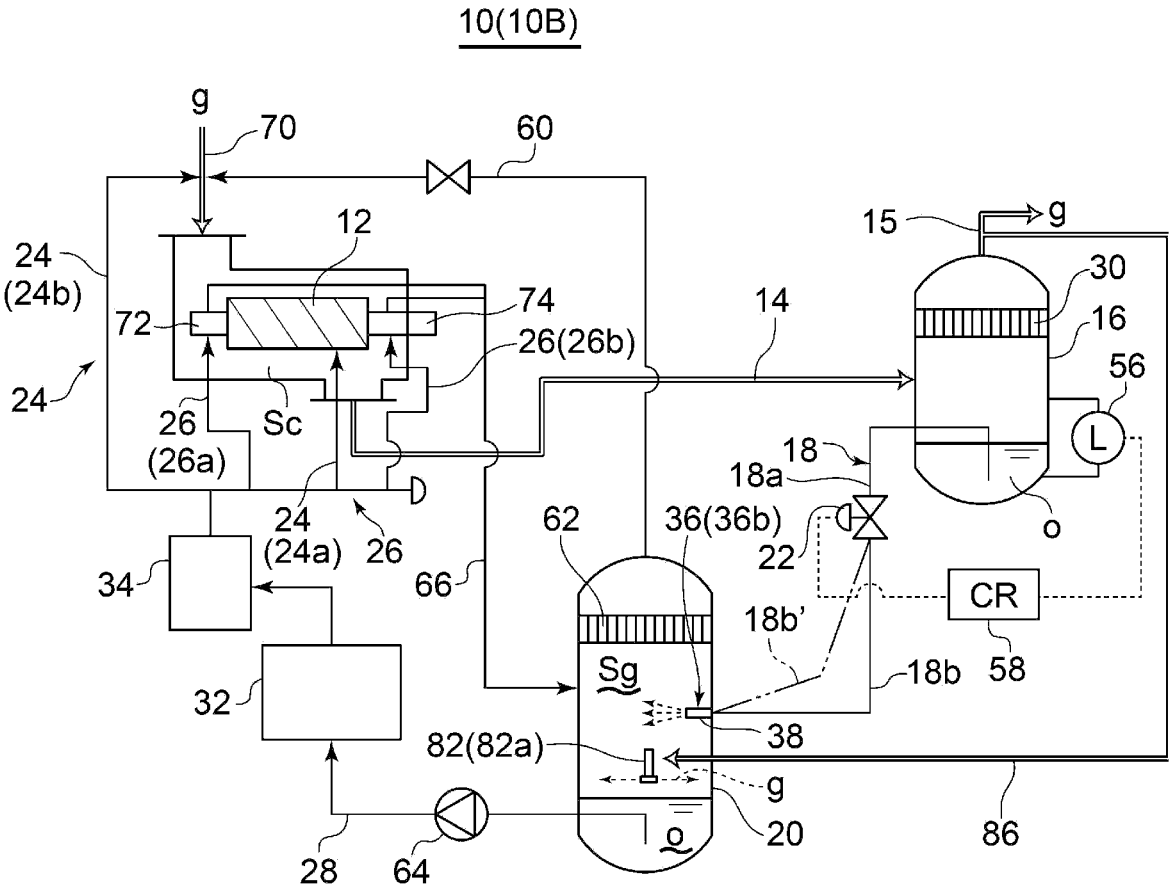
FIG. 2 is a system diagram of an oil supply system for the compressor according to another embodiment.

FIGS. 1 and 2 are each a system diagram of an oil supply system 10 (10A, 10B) for a compressor according to some embodiments. In FIGS. 1 and 2, a compressor 12 is an oil injection type compressor, and Sc in the figure schematically shows a compression space formed in the compressor 12. A discharge pipe 14 for discharging a compressed gas g is connected to an oil separator 16. The compressed gas g, which is mixed with oil o discharged from the compressor 12 to the discharge pipe 14, is separated from the oil o in the oil separator 16, and the compressed gas g separated from the oil o is supplied to a usage destination via a pipe 15. The oil o separated from the compressed gas g forms an oil sump at the bottom of the oil separator 16.

Further, the oil supply system 10 includes an oil tank 20 for receiving the oil o accumulated in the lower part of the oil separator 16, and an oil pipe 18 connected to the oil separator 16 and the oil tank 20. The oil pipe 18 is provided with a pressure reducing valve 22 and an agitator 36 (36*a*, 36*b*). Further, the oil supply system 10 includes oil lines 24 and 26 for supplying the oil o separated from the compressed gas g to the compressor 12, and an oil supply pipe 28 for supplying the oil o accumulated at the bottom of the oil tank 20 to the oil lines 24 and 26.

In the above configuration, when the oil o accumulated in the oil separator 16 is sent to the oil tank 20 through the oil pipe 18, a pressure is reduced by the pressure reducing valve 22, as well as the oil o is agitated by the agitator 36 and forms a turbulent flow. Thus, since the oil o flowing through the oil pipe 18 is agitated under the reduced pressure, a dissolved component of the compressed gas g dissolved in the oil o starts to be degassed in the oil pipe 18. Further, the dissolved component is degassed from an oil sump surface in the oil tank 20 as well, separating the dissolved component of the compressed gas g from the oil o with high efficiency. Thus, it is possible to supply the oil, where the amount of the dissolved compressed gas g is small and a viscosity is not decreased, from the oil tank 20 to the compressor 12, making it possible to sufficiently maintain a lubricant function in a bearing, a seal portion, and the like of the compressor 12. Further, even if a retention time of the oil o in the oil tank 20 is relatively short, or even if the volume of the oil tank 20 is small, the compressed gas g in the oil o can be separated with high efficiency, making it possible to efficiently operate the oil supply system 10, as well as to reduce the size of the oil tank 20.

Further, conventionally, a method for promoting degassing of a gas-dissolving component by heating the oil o flowing through the oil pipe 18 or the oil o accumulated in the oil tank 20 has also been adopted. However, in the present embodiment, since the highly-efficient separation is possible without adopting such method, there is no need to install a heating device or the like. Furthermore, unlike the conventional case, it is not necessary to use high-viscosity oil, but low-viscosity oil can be used. Thus, during startup of the compressor 12, it is possible to suppress occurrence of poor lubricant, poor sealing, abnormal wear, and the like in the bearing, the seal portion, and the like, and the problem such as an increase in starting torque does not arise. Moreover, since the low-viscosity oil can be used, the viscosity does not increase above a permissible value even if an oil supply temperature is lowered. Therefore, there is no risk that a temperature of a sliding surface of the bearing or the seal portion increases excessively.

In an embodiment, the oil separator 16 and the oil tank 20 form internal spaces, and demisters 30 and 62 are disposed in these internal spaces, respectively. In the oil separator 16, the compressed gas g separated from the oil o has a liquid content such as the oil o removed by the demister 30, and is supplied to the use destination via the pipe 15. In the oil tank 20, the compressed gas g separated from the oil o has a liquid content such as the oil o removed by the demister 62, and is returned to the compressor 12. In the embodiments shown in FIGS. 1 and 2, the compressed gas g is returned to a suction gas supply line 70 of the compressor 12 via a gas pipe 60.

Further, in an embodiment, the oil supply pipe 28 includes an oil cooler 32 and an oil filter 34 downstream of the oil cooler 32. The oil o sent from the oil tank 20 to the compressor 12 via the oil supply pipe 28 is cooled in the oil cooler 32, if necessary, and then contaminants are removed in the oil filter 34.

In the embodiments shown in FIGS. 1 and 2, the oil supply pipe 28 communicates with the oil line 24 for supplying the oil o to the compression space Sc, and the other oil line 26. The oil line 24 includes, for example, an oil line 24 (24*a*) for supplying the oil o into the compressed gas g in the compression process in the compressor 12, and an oil line 24 (24*b*) connected to the suction gas supply line 70 for the compressed gas g and serving as an oil line for replenishment in case of shortage in oil flow. The oil line 26 is, for example, an oil line for supplying oil to the bearing, the seal portion, such as a mechanical seal, and the like of the compressor 12.

As another embodiment, if the compressor 12 is, for example, a screw compressor, and includes a slide valve varying a capacity, a balance piston for reducing a thrust load applied to a screw rotor, and the like, an oil line for supplying the oil o to a piston cylinder for operating the above-described components is provided. In this case, since high-pressure oil is required to operate the slide valve and the balance piston, the high-pressure oil is supplied to the above-described oil line by an oil pump 64 disposed on the oil supply pipe 28, the oil lines 24 and 26, which do not require the high-pressure oil very much, are each provided with a throttle valve, and the pressure-reduced oil o is supplied from these oil line to the compressor 12.

In an embodiment, the compressor 12 is applied to a refrigeration system constituting a refrigeration cycle, or a heat pump system constituting a heat pump cycle capable of supplying cold and hot heat to the use destination. When applied to the above-described system, the compressor 12 is disposed on a refrigerant circulation path, and in the embodiments shown in FIGS. 1 and 2, the compressed gas g corresponds to the refrigerant, and the discharge pipe 14 and the pipe 15 constitute a part of the refrigerant circulation path.

In an embodiment, as shown in FIGS. 1 and 2, in the oil pipe 18, the agitator 36 is disposed downstream of the pressure reducing valve 22. In the present embodiment, it is possible to form the turbulent flow by agitating, with the agitator 36, the oil o whose pressure is reduced through the pressure reducing valve 22. With a synergistic effect of the pressure reduction by the pressure reducing valve 22 and the agitation action by the agitator 36, degassing of the compressed gas g starts immediately in the oil pipe 18 downstream of the agitator 36, and further, it is possible to promote degassing of the gas-dissolved component dissolved in the oil o in the oil tank 20 as well. Therefore, it is possible to decrease the amount of the dissolved compressed gas g which is contained in the oil o accumulated in the oil sump of the oil tank 20.

In an embodiment, as shown in FIGS. 1 and 2, the oil pipe 18 is connected to a gas phase portion Sg of the oil tank 20. As described above, the oil o flowing through the oil pipe 18 has considerably been degassed of the dissolved gas in the oil pipe 18 via the pressure reducing valve 22 and the agitator 36. In the present embodiment, the oil o and the compressed gas g degassed from the oil o flow out from an outlet of the oil pipe 18 to the gas phase portion Sg of the oil tank 20, allowing the compressed gas g degassed from the oil o to return to the compressor 12 through the channel for the compressed gas g without being mixed with the oil sump accumulated in the lower part of the oil tank 20. Further, the compressed gas g dissolved in the oil o is degassed from the oil o while the oil o falls into the oil sump. Therefore, it is possible to decrease the amount of the dissolved compressed gas g which is contained in the oil o accumulated in the oil sump of the oil tank 20.

In an embodiment, as shown in FIGS. 1 and 2, the oil pipe 18 does not include a temperature regulating device for heating or cooling the oil o flowing through the oil pipe 18. Therefore, it is possible to reduce an equipment cost of the oil supply system 10. The oil supply system 10 cools the oil o by taking latent heat of evaporation from the oil when the compressed gas g dissolved in the oil o is vaporized, and thus does not require a device for cooling the oil o. Further, the solubility of the compressed gas can be lowered by increasing the temperature of the oil o, making it possible to promote degassing of the compressed gas g dissolved in the oil o. However, in the oil supply system 10, since it is possible to promote degassing of the compressed gas g dissolved in the oil o by the synergistic effect of the pressure reduction of the oil o by the pressure reducing valve 22 and the agitation action of the oil o by the agitator 36, a heating device for increasing the temperature of the oil o is not required.

In an embodiment, as shown in FIG. 1, the agitator 36 (36*b*) is constituted by a turbulator (turbulent device) 40 disposed in the oil pipe 18. By disposing the turbulator 40 in an appropriate place in the axial direction of the oil pipe 18, it is possible to constitute the agitator. In the present embodiments, the oil o forms the turbulent flow and is agitated while flowing through the turbulator 40, causing a pressure loss in the oil o. Thus, it is possible to promote degassing of the compressed gas g dissolved in the oil o.

Figure 3:
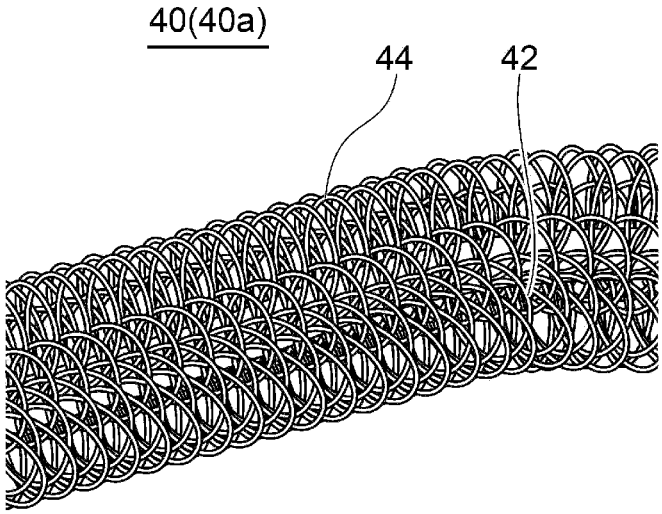
FIG. 3 is a perspective view of a turbulator used for an agitator according to an embodiment.
Figure 4:
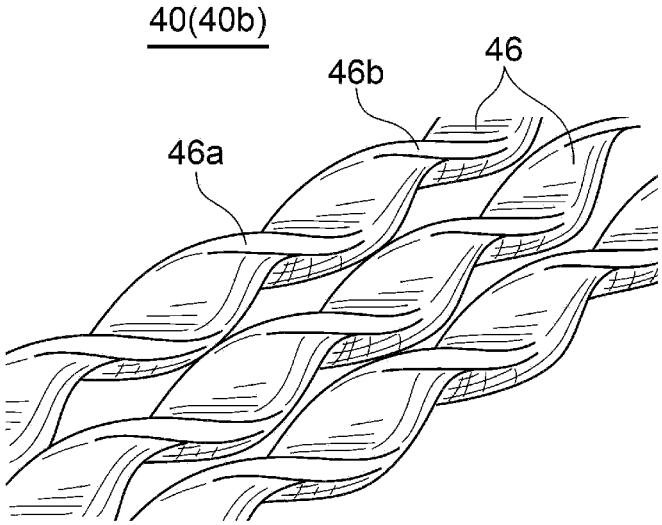
FIG. 4 is a perspective view of a turbulator used for the agitator according to another embodiment.
Figure 5:
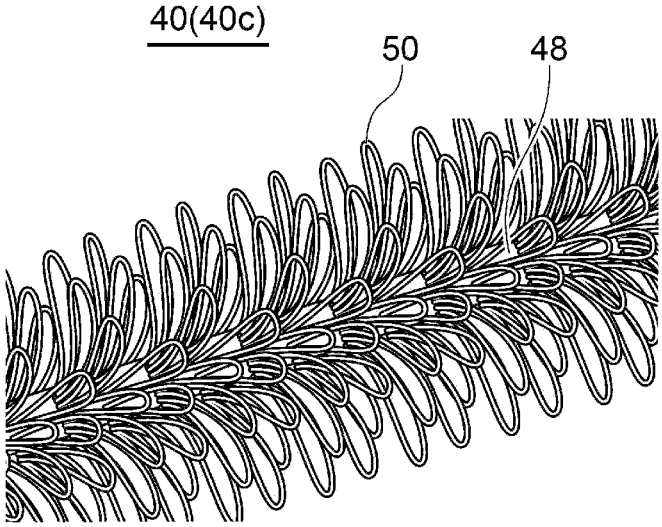
FIG. 5 is a perspective view of a turbulator used for the agitator according to still another embodiment.

FIGS. 3 to 5 are each a perspective view of the turbulator 40 according to some embodiments. The turbulator 40 (40*a*) shown in FIG. 3 includes a rod-shaped core 42, and a large number of loops 44 disposed around the core 42 and formed in a ring shape such as a circle or an ellipse. With the large number of loops 44 formed around the core 42, the oil o flowing through the oil pipe 18 is agitated by hitting against the loops 44 and forming the turbulent flow, causing the pressure loss. With the large number of loops 44 formed around the core 42, it is possible to increase the agitation effect of the oil o, and to promote vaporization of the compressed gas g dissolved in the oil o. For example, if at least the core 42 is made of a flexible material and the core 42 can freely be bent according to bending of the oil pipe 18 in the axial direction, it is easy to insert the core 42 into the oil pipe 18. Further, if the large number of loops 44 are disposed over the entire side cross-section of the oil pipe 18, it is possible to increase the turbulent flow forming action of the oil o. In the exemplary embodiment shown in FIG. 3, two cores 42, each having the large number of loops 44, are disposed in parallel along the axis of the oil pipe 18.

The turbulator 40 (40*b*) shown in FIG. 4 includes, for example, a plurality of rod-shaped bars 46 each having a rectangular side cross-section (a rectangle in the exemplary embodiment shown in FIG. 4), and each bar 46 is twisted along the axial direction, and a pair of faces 46*a* and 46*b* facing each other are spirally bent. Thus, each bar 46 is configured to form unevenness on the surface thereof. These plurality of bars 46 are inserted in parallel into the oil pipe 18 along the axial direction of the oil pipe 18. Since the surface of each bar 46 has the spiral unevenness, the oil o flowing through the oil pipe 18 is agitated by hitting against the bar 46 and forming the turbulent flow, causing the pressure loss in the oil o. Thus, it is possible to increase the agitation effect of the oil o, and to accelerate the speed at which the gas-dissolving component dissolved in the oil o vaporizes and separates from the oil.

The turbulator 40 (40*c*) shown in FIG. 5 includes a rod-shaped core 48, and a large number of loops 50 disposed around the core 48 and formed in a ring shape such as a circle or an ellipse (a rectangle in the exemplary embodiment shown in FIG. 5). By disposing the turbulator 40 (40*c*) in the oil pipe 18 along the axial direction of the oil pipe 18, the oil o flowing through the oil pipe 18 is agitated by hitting against the large number of loops 50 and forming the turbulent flow. Thus, the oil o causes the pressure loss and the agitation effect of the oil o can be increased, making it possible to accelerate the speed at which the gas-dissolving component dissolved in the oil o is degassed and separates from the oil. In the present embodiment as well, for example, as in the embodiment shown in FIG. 3, if at least the core 42 is made of the flexible material and the core 42 can freely be bent according to bending of the oil pipe 18 in the axial direction, it is easy to insert the core 42 into the oil pipe 18. Further, if the large number of loops 50 are disposed over the entire side cross-section of the oil pipe 18, it is possible to increase the turbulent flow forming action.

Figure 6A:
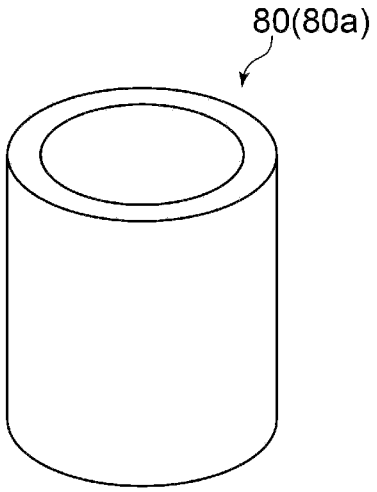
FIG. 6A is a perspective view showing a rashig ring as an irregular filling used in the agitator.
Figure 6B:
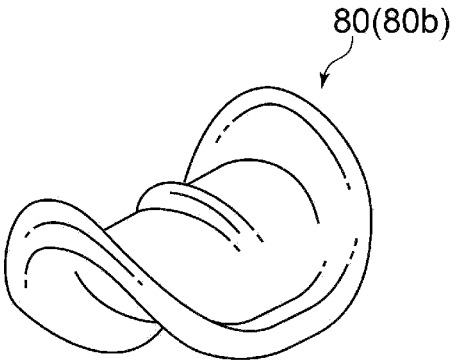
FIG. 6B is a perspective view showing a Berl saddle as the irregular filling used in the agitator.
Figure 6C:
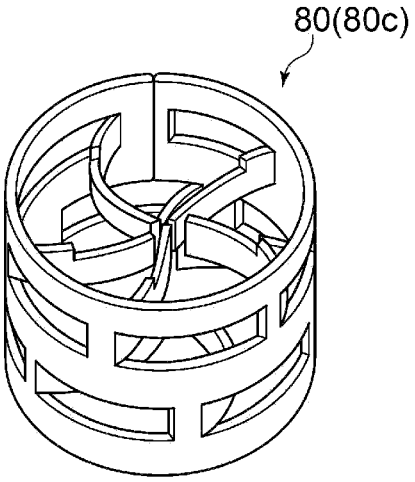
FIG. 6C is a perspective view showing a pall ring as the irregular filling used in the agitator.

In an embodiment, in addition to the turbulator 40, irregular fillings 80 (80*a*, 80*b*, 80*c*) respectively shown in FIGS. 6A and 6B are disposed in the oil pipe 18. The irregular filling 80 is, for example, a rashig ring 80 (80*a*) shown in FIG. 6A, a Berl saddle 80 (80*b*) shown in FIG. 6B, a pall ring 80 (80*c*), or the like. A large number of these irregular fillings are disposed so as to block the side cross-section of the oil pipe 18. Thus, the turbulent flow is formed in the oil o flowing through the channel where the irregular fillings 80 are disposed to agitate the oil and to cause the pressure loss, making it possible to further promote degassing the compressed gas g dissolved in the oil o.

Depending on the degree of degassing action required, the irregular fillings 80 may be disposed so as to block the entire side cross-section of the oil pipe 18, or may be disposed so as to block a part of the side cross-section. Further, the irregular fillings 80 may be disposed in the same place as the turbulator 40, or may be disposed in a different place in the axial direction of the oil pipe 18. By disposing the irregular fillings 80 in the place where the turbulator 40 is disposed, it is possible to increase the turbulent flow forming effect, and to increase the agitation effect.

Figure 7:
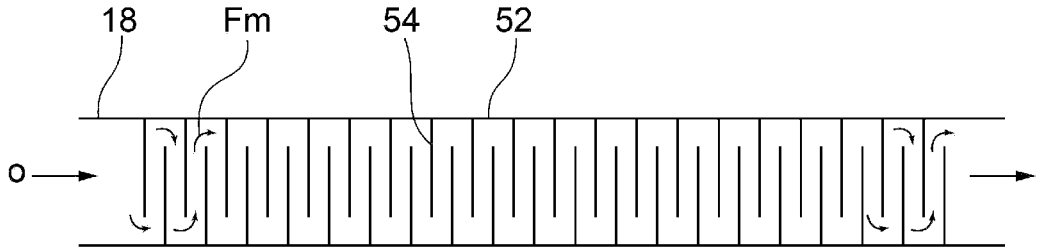
FIG. 7 is a vertical cross-sectional view of a serpentine channel portion used as the agitator.

In an embodiment, as shown in FIG. 7, the agitator 36 (36*a*) is constituted by a serpentine channel portion 52 formed in the channel of the oil pipe 18. The oil o flowing through the serpentine channel portion 52 meanders, causing the pressure loss and forming the turbulent flow. Thus, it is possible to increase the agitation effect of the oil o, and to promote degassing of the gas-dissolving component.

In the embodiment shown in FIG. 7, the serpentine channel portion 52 is formed by a large number of baffle plates 54 disposed in parallel in a direction intersecting with the axial direction of the oil pipe 18 (in the exemplary embodiment shown in FIG. 7, a direction normal to the axial direction of the oil pipe 18). The large number of baffle plates 54 are disposed in parallel at intervals along the axial direction of the oil pipe 18, and every other baffle plate 54 is disposed to be displaced in the radial direction of the oil pipe 18, forming a serpentine channel Fm. The oil o flows through the serpentine channel Fm, causing the pressure loss. Thus, it is possible to accelerate the speed at which the gas-dissolving component dissolved in the oil o vaporizes and separates from the oil o.

A portion of the oil pipe 18 provided with the agitator 36 (36*a*) may be a pipe having a larger diameter than another oil pipe 18, and this pipe may incorporate the turbulator 40 or may include the serpentine channel portion 52. Alternatively, as another embodiment, the portion of the oil pipe 18 provided with the agitator 36 (36*b*) may be constituted by a pipe having the same diameter as the another oil pipe 18.

Further, the serpentine channel Fm formed in the serpentine channel portion 52 may be filled with the irregular fillings 80. Thus, it is possible to increase the turbulent flow forming effect of the oil o flowing through the serpentine channel Fm, and to increase the agitation effect.

In an embodiment, as shown in FIG. 2, the agitator 36 (36*b*) includes a jet spray nozzle 38 disposed on the oil pipe 18 and opened to the oil tank 20. The oil o flowing through the oil pipe 18 is sprayed in the form of mist from the jet spray nozzle 38 to the gas phase portion Sg of the oil tank 20. Since the oil o is sprayed in the form of mist to the gas phase portion Sg, it is possible to promote degassing of the compressed gas g dissolved in the oil o.

In the exemplary embodiment shown in FIG. 2, the jet spray nozzle 38 is connected to the outlet of the oil pipe 18 in the oil tank 20.

The inside of the oil tank 20 has the same pressure as the internal pressure of the oil pipe 18 downstream of the pressure reducing valve 22, which is reduced by the pressure reducing valve 22. Thus, since the inside of the oil tank 20 has the reduced pressure, it is possible to promote the vaporization of the gas-dissolved component of the compressed gas g from the oil o sprayed to the gas phase portion Sg.

In an embodiment, as shown in FIG. 2, a nozzle port of the jet spray nozzle 38 opened to the inside of the oil tank 20 is oriented in the horizontal direction or at an angle close to the horizontal direction. Thus, it is possible to prolong a time for the oil o sprayed from the jet spray nozzle 38 to reach the oil sump accumulated in the lower part of the oil tank 20. Thus, it is possible to promote the vaporization of the gas-dissolved component of the compressed gas g from the sprayed oil o.

By orienting the nozzle port of the jet spray nozzle 38 diagonally upward, it is possible to further prolong the time for the oil o to reach the oil sump. Thus, it is possible to further promote the vaporization of the gas-dissolved component of the compressed gas g from the sprayed oil o.

In an embodiment, as shown in FIGS. 1 and 2, the oil supply system 10 includes a liquid level sensor 56 for detecting a liquid level of the oil o stored in the oil separator 16, and a controller 58 for controlling the opening of the pressure reducing valve 22 based on a detection value of the liquid level sensor 56. Thus, the controller 58 can always control the amount of the oil accumulated in the oil separator 16 to a desired amount. Therefore, it is possible to control the oil o accumulated in the oil separator 16 to an amount to be supplied to the oil tank 20. Therefore, it is possible to always secure the amount of the oil stored in the oil tank 20, and to always secure the flow of the oil o supplied from the oil tank 20 to the compressor 12 during operation.

A flow regulating valve may be provided in the oil pipe 18 separately from the pressure reducing valve 22, and the controller 58 may control the opening of the flow regulating valve to control the amount of the oil o accumulated in the oil separator 16. Thus, the pressure reducing function of the oil o flowing through the oil pipe 18 and the oil level adjusting function of the oil o accumulated in the oil separator 16 may be shared by the different valves.

In an embodiment, as shown in FIGS. 1 and 2, the oil supply system 10 includes a gas pipe 60 connecting the gas phase portion Sg of the oil tank 20 and the suction space of the compressor 12. With the gas pipe 60, it is possible to supply the compressed gas g separated into the gas phase portion Sg of the oil tank 20 to the suction space of the compressor 12, and to reduce the pressure in the gas phase portion Sg to the same pressure as the suction space of the compressor 12. Thus, it is possible to vaporize the gas-dissolving component, which is contained in the oil o flowing out from the oil pipe 18 to the oil tank 20, in the gas phase portion Sg under reduced pressure to be separated from the oil o. In particular, in the oil supply system 10 (10B) shown in FIG. 2, it is possible to promote the vaporization of the gas-dissolved component of the compressed gas g from the misty oil o sprayed from the jet spray nozzle 38 to the gas phase portion Sg.

In the exemplary embodiment shown in FIG. 1, the gas pipe 60 is connected to the suction gas supply line 70 communicating with a suction port of the compressor 12 on the side of the compressor 12, and the compressed gas g in the gas phase portion Sg of the oil tank 20 is returned to the suction gas supply line 70.

In the embodiment shown in FIG. 1, the oil tank 20 is constituted by a vessel which is long in the vertical direction, and the gas pipe 60 is connected to the top of the vessel. The demister 62 is disposed below the top to which the gas pipe 60 is connected. Since the demister 62 captures the liquid content such as the oil content, it is possible to prevent the liquid content from entering the compression space Sc of the compressor 12 via the gas pipe 60.

In an embodiment, as shown in FIGS. 1 and 2, the oil supply pipe 28 for supplying the oil o to the oil lines 24 and 26 for supplying the oil o to the compressor 12 includes an oil pump 64. Since the oil supply pipe 28 includes the oil pump 64, it is possible to supply, without any trouble, the oil o from the low-pressure oil tank 20 to the compression space Sc of the compressor 12 having the higher pressure than the oil tank 20 and the oil supply portion of the compressor 12 including the bearing portion.

In the exemplary embodiments shown in FIGS. 1 and 2, the oil supply pipe 28 is branched into the oil line 24 for supplying the oil o to the compression space Sc on the downstream side, and the oil line 26 for supplying the oil o to the bearing, the seal portion, and the like of the compressor 12.

In an embodiment, as shown in FIGS. 1 and 2, the compressor 12 is constituted by the screw compressor. Then, the oil supply system 10 (10A, 10B) includes the oil line 24 for supplying oil to the compression space Sc, and at least the oil line 26 (26*a*, 26*b*) for supplying the oil o to bearings of screw rotors 72 and 74 composing the screw compressor. According to the oil supply system 10, it is possible to supply the oil o, where the amount of the dissolved compressed gas g is small and the viscosity is not decreased, not only to the compression space Sc but also to the bearings, other seal portions, and the like of the screw rotors 72 and 74. Thus, it is possible to maintain the lubricant effect and the sealing effect of the bearings, the sealing portions, and the like.

In the exemplary embodiments shown in FIGS. 1 and 2, the oil o supplied from the oil lines 24 and 26 to the compressor 12 is returned to the gas phase portion Sg of the oil tank 20 from the bearings, other seal portions, and the like of the screw rotors 72 and 74 via an oil return pipe 66. Since the compression space Sc and the bearings, other seal portions, and the like of the compressor 12 have the higher pressure than the oil tank 20, by using the differential pressure, it is possible to easily return the oil o to the oil tank 20.

In an embodiment, the oil supply system 10 includes a defoaming device 82 for suppressing foams generated on the surface of the oil o accumulated in the lower part of the oil tank 20. With the defoaming device 82, it is possible to extinguish foaming generated on the oil sump surface formed in the lower part of the oil tank 20, and by removing the foams on the oil sump surface, it is possible to promote degassing of the compressed gas g from the oil sump surface. Further, it is possible to control the liquid level of the oil o accumulated in the oil tank 20, without any trouble.

Figure 8:
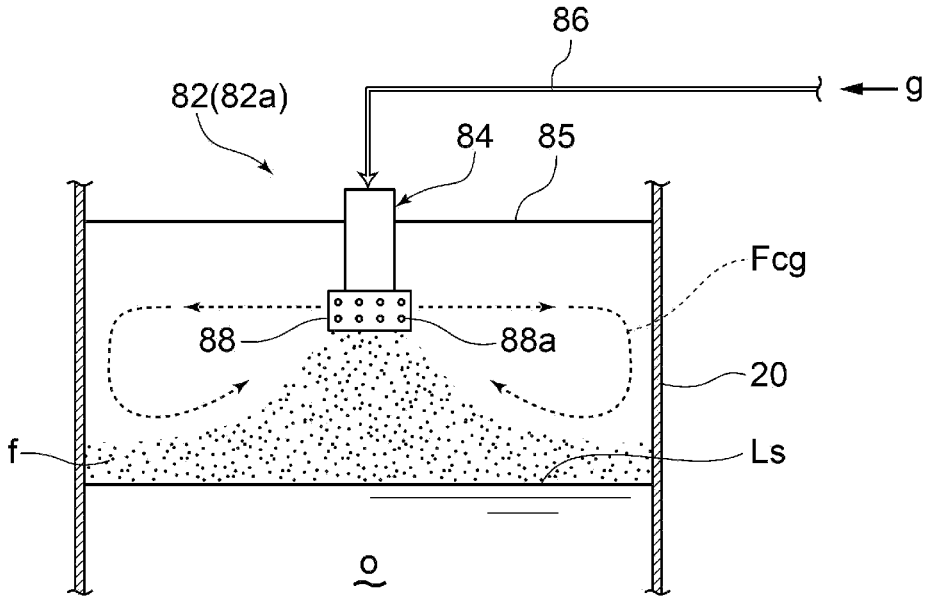
FIG. 8 is a front view of a defoaming device according to an embodiment.

FIG. 8 is a front view of the defoaming device 82 (82*a*) according to an embodiment, and is a view of the cutoff oil tank 20. As shown in FIG. 8, provided are a nozzle body 84 disposed in the upper center of the oil sump surface in the oil tank 20, and a pipe 86 connected to the pipe 15 and the nozzle body 84 to branch off a part of the compressed gas g flowing through the pipe 15 to be supplied to the nozzle body 84. For example, the nozzle body 84 includes a tubular casing and includes a spray tube 88 having a larger diameter than the casing at the lower part of the casing, and the outer circumferential surface of the spray tube 88 has spray holes 88*a* formed in the entire circumferential surface. The nozzle body 84 and the spray holes 88*a* may each have a side cross-section of a circular, elliptical or square shape. The nozzle body 84 is supported by a support member 85 above the oil sump surface at the center in the oil tank 20.

A part of the compressed gas g flowing through the pipe 15 is brought into the nozzle body 84 via the pipe 86. The compressed gas g brought into the nozzle body 84 is horizontally sprayed from the spray holes 88*a* to the radially outer side of the spray tube 88. The compressed gas g sprayed from the spray holes 88*a* forms a circulating flow Fcg which goes downward from an inner wall surface of the oil tank 20 and further goes toward a center side in the oil tank 20. Foams f generated on the oil sump surface by the circulating flow Fcg are collected to the center side in the oil tank 20 and are extinguished by the compressed gas g which is sprayed from the spray holes 88*a* formed in a bottom surface of the spray tube 88.

Figure 9:
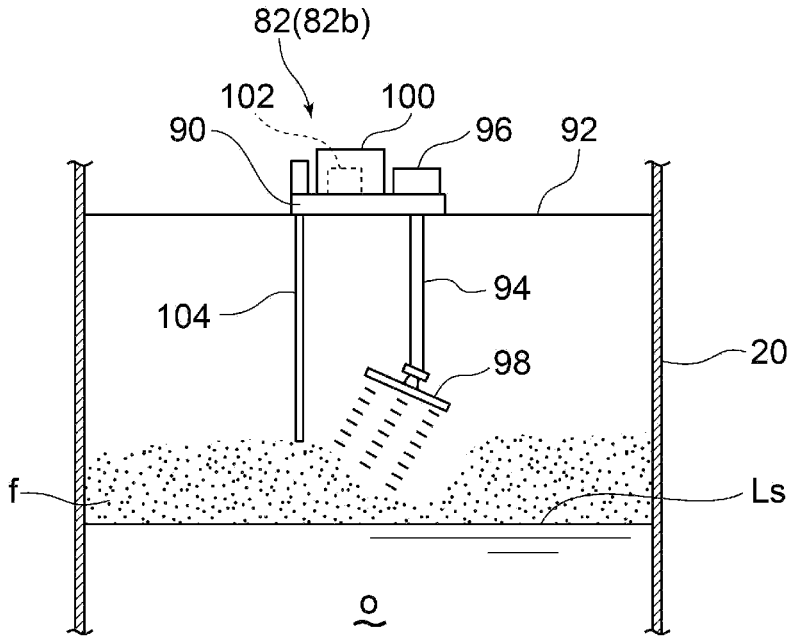
FIG. 9 is a front view of a defoaming device according to another embodiment.

FIG. 9 is a front view of the defoaming device 82 (82*b*) according to another embodiment, and is a view of the cutoff oil tank 20. The defoaming device 82 (82*b*) has a base portion 90 which is supported by the support member 92 at an inner center of the oil tank 20 and above the oil sump surface. A rotational shaft 94 is vertically hung from the base portion 90, and the rotational shaft 94 is rotated about the axis by a drive portion 96 fixed to an upper surface of the base portion 90. A disk-shaped ultrasonic oscillator 98 is attached to a lower end of the rotational shaft 94. Ultrasonic waves can oscillate from the ultrasonic oscillator 98 toward the foams f generated downward. Further, the ultrasonic oscillator 98 is disposed obliquely to the vertical direction, and with the rotation of the rotational shaft 94, it possible to oscillate the ultrasonic waves over a wide range from the ultrasonic oscillator 98 with respect to the foams f. The angle of the ultrasonic oscillator 98 with respect to the vertical direction is configured to be adjustable, and by adjusting the angle of the ultrasonic oscillator 98 with respect to the vertical direction, it is possible to adjust the range in which the ultrasonic waves can be applied to the foams f.

Further, a controller 102 is disposed in a casing 100 fixed to the base portion 90, and a rod-shaped foam sensor 104 is vertically hung from the base portion 90. If a lower end of the foam sensor 104 touches the foams f, the foam sensor 104 detects the foams f and the detection signal is sent to the controller 102. Upon receiving the detection signal, the controller 102 operates the ultrasonic oscillator 98 to oscillate the ultrasonic waves from the ultrasonic oscillator 98 toward the foams f. Thus oscillating the ultrasonic waves toward the foams f, it is possible to extinguish the foams f. According to the defoaming device 82 (82*b*), if the foams f reach a predetermined height, the foam sensor 104 detects it and automatically operates to extinguish the foams f.

Figure 10:
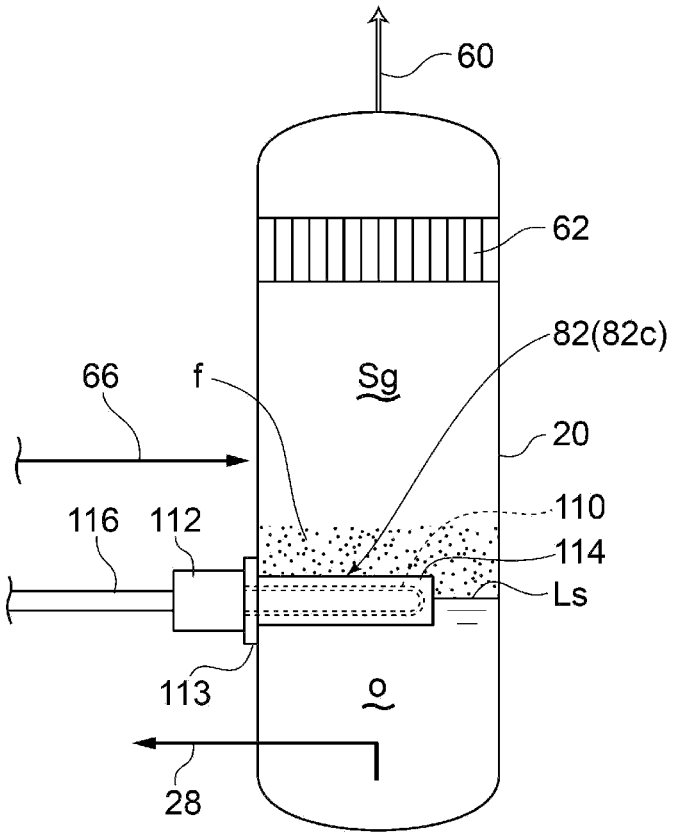
FIG. 10 is a front view of a defoaming device according to still another embodiment.

FIG. 10 is a front view of the defoaming device 82 (82*c*) according to still another embodiment, and is a view of the cutoff oil tank 20. The defoaming device 82 (82*c*) includes an electrically heated or steam heated heater 110. The defoaming device 82 (82*c*) includes a base portion 112, a flange portion 113, and a tubular casing 114 incorporating the heater 110, and has a shape in which these constituent elements are linearly arranged in series. The casing 114 is inserted into the oil tank 20, and the flange portion 113 is mounted in a state of being in contact with the outer surface of the oil tank 20. The base portion 112 is disposed outside the oil tank 20. The casing 114 is disposed at a height near a surface Ls of the oil sump with the longitudinal direction along the surface Ls.

If the defoaming device 82 (82*c*) is of an electric heating type, the heater 110 includes a heat transfer wire connected to a conductive wire 116, and the heater 110 is heated by energizing the heat transfer wire of the heater 110 via the conductive wire 116 from a power source (not shown). The foams f generated on the surface Ls of the oil sump disappear by being heated by the heater 110.

If the defoaming device 82 (82*c*) is of a steam heating type, the heater 110 includes a steam tube into which steam is brought, and the conductive wire 116 includes a steam conduit for supplying steam to the steam tube. By supplying steam to the steam tube of the heater 110 via the steam conduit, the surrounding foams f are heated and extinguished.

Figure 11:
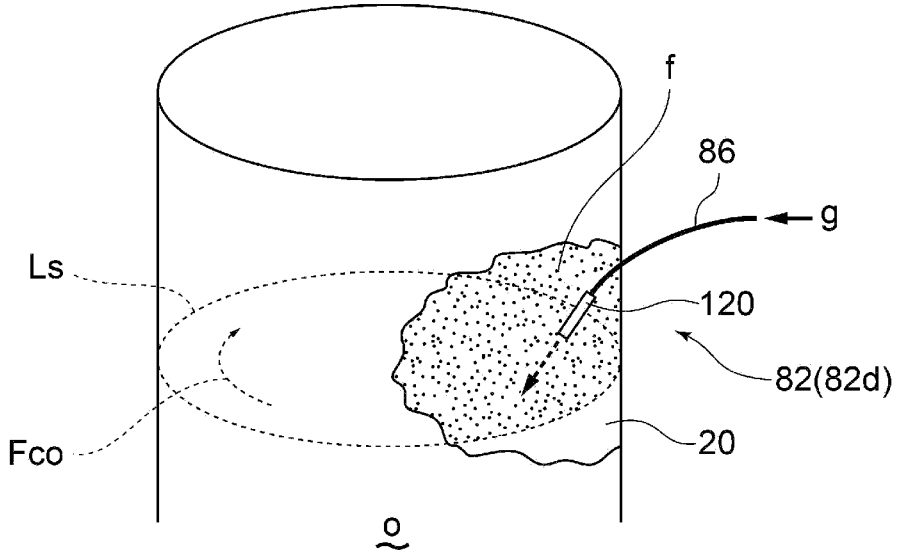
FIG. 11 is a perspective view of a defoaming device according to yet another embodiment.

FIG. 11 is a perspective view showing the oil tank 20, a part of which is cut off, of the defoaming device 82 (82*d*) according to yet another embodiment. The defoaming device 82 (82*d*) includes a nozzle 120 disposed in the oil tank 20, and a pipe 86 connected to the pipe 15 and the nozzle 120. The compressed gas g is supplied to the nozzle 120 via the pipe 86. The nozzle 120 is located above the surface Ls of the oil sump and close to a wall surface of the oil tank 20. The nozzle 120 has a nozzle port which is disposed toward the surface Ls of the oil sump formed below and is disposed not in the vertical direction but diagonally in the circumferential direction of the oil tank 20.

With the above configuration, if the compressed gas g is injected from the nozzle 120, a circulating flow Fco of the oil o is formed on the surface Ls of the oil sump by a force of the compressed gas g injected from the nozzle 120. If the circulating flow Fco is formed on the surface Ls of the oil sump, the foams f generated above the surface Ls also circulate in the same direction as the circulating flow Fco. Thus, the foams f sequentially move to a position where the foams hit against the compressed gas g blown out from the nozzle 120, and thus are sequentially blown off by the compressed gas g blown out from the nozzle 120 and disappear.

In an embodiment, a pipe portion of the oil pipe 18 from the pressure reducing valve 22 to a connection end with the oil tank 20 is horizontal or inclined downward toward the downstream side. In FIG. 2, of the oil pipe 18, an upstream pipe portion from the oil separator 16 to the pressure reducing valve 22 is denoted by reference symbol 18*a*, and a downstream pipe portion from the pressure reducing valve 22 to the connection end with the oil tank 20 is denoted by reference symbol 18*b*. Then, the downstream pipe portion 18*b* according to the present embodiment is represented by a double-dotted chain line and is denoted by reference symbol 18*b'*.

According to the present embodiment, since the downstream pipe portion 18*b'* is disposed horizontally or obliquely downstream downward toward the downstream side, a head difference does not occur which offsets the pressure reduction amount by the pressure reducing valve 22 with the oil o flowing through the downstream pipe portion 18*b'*. Therefore, even if the pressure reduction amount by the pressure reducing valve 22 is increased, it is possible to secure an oil flow toward the oil tank 20 in the downstream pipe portion 18*b'*. That is, unlike a U-shaped bent portion, the compressed gas g is not trapped. Thus, it is possible to suppress retention of the compressed gas g degassed from the oil o in the downstream pipe portion 18*b'*, making it possible to suppress that the degassed compressed gas g is redissolved in the oil o during the retention in the downstream pipe portion 18*b'*. Further, compared to a case where the downstream pipe portion 18*b'* is disposed in the vertical direction, it is possible to prolong the retention time of the oil o in the downstream pipe portion 18*b'*, making it possible to secure a degassing time of the dissolved gas in the downstream pipe portion 18*b'*.

In an embodiment, the downstream pipe portion 18*b* is configured to have a larger channel cross-sectional area than the upstream pipe portion 18*a*. According to the present embodiment, it is possible to increase a pressure-reduced space where the pressure is reduced by the pressure reducing valve 22 in the oil pipe, making it possible to prolong the retention time of the oil o in the pressure-reduced space. Thus, it is possible to further promote degassing of the compressed gas g from the oil o.

In an embodiment, the downstream pipe portion 18*b* is configured be to longer than half of the full length of the oil pipe 18. According to the present embodiment, since it is possible to increase the pressure-reduced space where the pressure is reduced by the pressure reducing valve 22 in the oil pipe, it is possible to prolong the retention time of the oil o in the pressure-reduced space, making it possible to further promote degassing of the compressed gas g.

The contents described in the above embodiments would be understood as follows, for instance.

1) An oil supply system (10) for a compressor according to an aspect includes an oil separator (16) connected to a discharge pipe (14) of the compressor (12), an oil tank (20) for receiving oil (o) from an oil sump of the oil separator (16), an oil pipe (18) disposed between the oil separator (16) and the oil tank (20), a pressure reducing valve (22) disposed on the oil pipe (18), an oil supply pipe (28) for supplying the oil to an oil line (24, 26) for supplying the oil to the compressor (12) from an oil sump of the oil tank (20), and an agitator (36) disposed on the oil pipe (18).

With the above configuration, when the oil separated from a compressed gas in the oil separator is sent to the oil tank through the above-described oil pipe, a pressure is reduced by the above-described pressure reducing valve, as well as the oil is agitated by the above-described agitator and forms a turbulent flow. With a synergistic effect of the pressure reduction by the pressure reducing valve and the agitation action by the agitator, degassing of the compressed gas dissolved in the oil starts in the oil pipe, making it possible to achieve separation of the oil from the compressed gas in the oil tank with high efficiency. Thus, it is possible to supply the oil, where the amount of gas-dissolving components is small and the viscosity is not decreased, from the oil tank to the compressor, making it possible to secure a lubricant function and a sealing function particularly in a bearing, a seal portion, and the like of the compressor. Further, even if a retention time of the oil in the oil tank is relatively short, or even if the volume of the oil tank is small, it is possible to achieve separation of the oil from the compressed gas with high efficiency. Thus, it is possible to efficiently operate the oil supply system, as well as to reduce the size of the oil tank.

2) The oil supply system (10) for the compressor according to another aspect is the oil supply system for the compressor as defined in 1), where the agitator (36) is disposed on the oil pipe (18) downstream of the pressure reducing valve (22).

With the above configuration, since the oil whose pressure is reduced through the pressure reducing valve is agitated by the agitator, it is possible to promote degassing of the compressed gas dissolved in the oil.

3) The oil supply system (10) for the compressor according to still another aspect is the oil supply system for the compressor as defined in 1) or 2), where the oil pipe (18) is connected to a gas phase portion (Sg) of the oil tank (20).

With the above configuration, since the oil and the compressed gas degassed from the oil flow out from an outlet of the oil pipe to the gas phase portion of the oil tank, it is possible to prevent the compressed gas degassed from the oil from mixing in the oil sump of the oil tank and being redissolved. Further, degassing of the gas-dissolving component, which has not been degassed from the oil, from the oil is also promoted when the gas-dissolving component is released to the gas phase portion.

4) The oil supply system (10) for the compressor according to yet another aspect is the oil supply system for the compressor as defined in any one of 1) to 3), where the oil pipe (18) does not include a temperature regulating device for heating or cooling the oil (o) flowing through the oil pipe (18).

With the above configuration, since the oil pipe (18) does not include the above-described temperature regulating device, it is possible to reduce an equipment cost. The oil supply system for the compressor according to the above embodiment cools the oil by taking latent heat of evaporation from the oil when the compressed gas dissolved in the oil is vaporized, and thus the oil pipe does not require a device for cooling the oil. Further, since the oil supply system for the compressor according to the above embodiment promotes degassing of the compressed gas dissolved in the oil by the pressure reducing valve and the agitator disposed on the oil pipe, the oil supply system does not require a heating device for promoting degassing of the dissolved compressed gas by increasing the temperature of the oil and reducing the solubility of the compressed gas.

5) The oil supply system (10) for the compressor according to yet another aspect is the oil supply system for the compressor as defined in any one of 1) to 4), where the agitator (36) includes a turbulator (turbulent device) (40) disposed in the oil pipe (18).

With the above configuration, it is possible to promote degassing of the compressed gas dissolved in the oil by agitating the oil by causing a turbulent flow in the oil with the turbulator and by causing a pressure loss.

6) The oil supply system (10) for the compressor according to yet another aspect is the oil supply system for the compressor as defined in any one of 1) to 4), where the agitator (36) includes a serpentine channel portion (52) formed in a channel of the oil pipe (18).

With the above configuration, it is possible to promote degassing of the compressed gas dissolved in the oil by agitating the oil flowing through the above-described serpentine channel portion by causing the turbulent flow in the oil and by causing the pressure loss.

7) The oil supply system (10) for the compressor according to yet another aspect is the oil supply system for the compressor as defined in 3), where the agitator (36) includes a spray nozzle (38) disposed on the oil pipe (18) and opened to the gas phase portion (Sg) of the oil tank (20).

With the above configuration, the oil flowing into the oil tank from the oil pipe is sprayed in the form of mist from the above-described spray nozzle to the gas phase portion of the oil tank, making it possible to promote degassing of the compressed gas dissolved in the oil.

8) The oil supply system (10) for the compressor according to yet another aspect is the oil supply system for the compressor as defined in any one of 1) to 7) that includes a liquid level sensor (56) for detecting a liquid level of the oil (o) stored in the oil separator (16) and a control part (58) for controlling an opening of the pressure reducing valve (22) based on a detection value of the liquid level sensor (56).

With the above configuration, the above-described control part can control the amount of the oil accumulated in the oil separator. Thus, it is possible to always control the amount of the oil accumulated in the oil separator to an amount to be supplied to the oil tank. Therefore, it is possible to always secure the amount of the oil stored in the oil tank, and to always secure the oil supplied from the oil tank to the compressor during operation.

9) The oil supply system (10) for the compressor according to yet another aspect is the oil supply system for the compressor as defined in any one of 1) to 8) that includes a gas pipe (60) connecting a gas phase portion (Sg) of the oil tank (20) and a suction space of the compressor (12).

With the above configuration, since the gas phase portion of the oil tank communicates with the suction space of the compressor via the above-described gas pipe, it is possible to return the compressed gas separated from the oil to the suction space of the compressor in the oil tank, as well as it is possible to reduce the pressure in the gas phase portion of the oil tank to the same pressure as the suction space of the compressor. Thus, it is possible to promote degassing of the gas-dissolving component which is dissolved in the oil flowing into the oil tank.

10) The oil supply system (10) for the compressor according to yet another aspect is the oil supply system for the compressor as defined in any one of 1) to 9), where the oil supply pipe (28) includes an oil pump (64).

With the above configuration, since the above-described oil supply pipe includes the above-described oil pump, it is possible to supply, without any trouble, the oil from the oil tank of a low-pressure atmosphere to the compression space of the compressor having the higher pressure than the oil tank and the oil supply portions of the compressor including the bearing portion and the like.

11) The oil supply system (10) for the compressor according to yet another aspect is the oil supply system for the compressor as defined in any one of 1) to 10), where the compressor (12) is constituted by a screw compressor, and the oil line (24, 26) includes at least an oil line (26) for supplying the oil to a bearing of a screw rotor (72, 74) composing the screw compressor.

With the above configuration, it is possible to supply the oil o, where the amount of the dissolved gas-dissolving components is small and the viscosity is not decreased, to the bearing of the screw rotor 72 composing the screw compressor and another oil supply portion. Thus, it is possible to maintain the lubricant effect of the oil supply portion such as the bearing.

12) The oil supply system (10) for the compressor according to yet another aspect is the oil supply system for the compressor as defined in any one of 1) to 11) that includes a defoaming device (82) for suppressing foams (f) which are generated on a surface of the oil (o) accumulated in the oil tank (20).

With the above configuration, it is possible to extinguish foaming generated on the oil sump surface in the oil tank, and by removing the foams on the oil sump surface, it is possible to promote degassing of the compressed gas from the oil sump surface. Further, it is possible to control the liquid level of the oil accumulated in the oil tank, without any trouble.

13) The oil supply system (10) for the compressor according to yet another aspect is the oil supply system for the compressor as defined in any one of 1) or 12), where a pipe portion (18*b*') of the oil pipe (18) from the pressure reducing valve (22) to a connection end with the oil tank (20) is horizontal or inclined downward toward a downstream side.

With the above configuration, without a head difference which offsets the pressure reduction amount by the pressure reducing valve occurring in the above-described pipe portion, even if the pressure reduction amount by the pressure reducing valve is increased, it is possible to secure an oil flow toward the oil tank in the above-described pipe portion. Thus, it is possible to suppress retention of the compressed gas degassed from the oil in the above-described pipe portion, making it possible to suppress that the degassed compressed gas is redissolved during the retention. Further, compared to a case where the above-described pipe portion is disposed in the vertical direction, it is possible to prolong the retention time of the oil in the above-described pipe portion, making it possible to secure a degassing time of the dissolved gas in the oil pipe.

14) The oil supply system (10) for the compressor according to yet another aspect is the oil supply system for the compressor as defined in any one of 1) to 13), where a portion (18*b*) of the oil pipe (18) downstream of the pressure reducing valve (22) has a larger channel cross-sectional area than a portion (18*a*) of the oil pipe (18) upstream of the pressure reducing valve (22).

With the above configuration, it is possible to increase a pressure-reduced space where the pressure is reduced by the pressure reducing valve in the oil pipe, making it possible to prolong the retention time of the oil in the pressure-reduced space. Thus, it is possible to promote degassing of the compressed gas from the oil.

15) The oil supply system (10) for the compressor according to yet another aspect is the oil supply system for the compressor as defined in any one of 1) to 14), where a portion (18*b*) of the oil pipe (18) downstream of the pressure reducing valve (22) is longer than half of a full length of the oil pipe (18).

With the above configuration, it is possible to increase a pressure-reduced space where the pressure is reduced by the pressure reducing valve in the oil pipe, making it possible to prolong the retention time of the oil in the pressure-reduced space. Thus, it is possible to promote degassing of the compressed gas from the oil.

REFERENCE SIGNS LIST

10 (10A, 10B) Oil supply system for compressor
12 Compressor
14 Discharge pipe
15, 86 Pipe
16 Oil separator
18 Oil pipe
18*a* Upstream pipe portion
18B, 18*b*' Downstream pipe portion
20 Oil tank
22 Pressure reducing valve
24 (24*a*, 24*b*), 26 (26*a*, 26*b*) Oil line
28 Oil supply pipe
30, 62 Demister
32 Oil cooler
34 Oil filter
36 (360*a*, 36*b*) Agitator
38 Jet spray nozzle
40 (40*a*, 40*b*, 40*c*) Turbulator
42, 48 Core
44, 50 Loop
46 Bar
52 Serpentine channel portion
54 Baffle plate
56 Liquid level sensor
58, 102 Controller
60 Gas pipe
64 Oil pump
66 Oil return pipe
70 Suction gas supply line
72, 74 Screw rotor
80 (80*a*, 80*b*, 80*c*) Irregular filling
80*a* Rashig ring
80*b* Berl saddle
80*c* Pall ring
82 (82*a*, 82*b*, 82*c*, 82*d*) Defoaming device
84 Nozzle body
85, 92 Support member
88 Spray tube
88*a* Spray hole
90, 112 Base portion
94 Rotational shaft
96 Drive portion
98 Ultrasonic oscillator
100, 114 Casing
104 Foam sensor
110 Heater
113 Flange portion
116 Conductive wire
120 Nozzle
Fcg, Fco Circulating flow
Fm Serpentine channel
Ls Oil sump surface
Sc Compression space
Sg Gas phase portion
f Foam
g Compressed gas
Oil

The invention claimed is:

1. An oil supply system for a compressor, comprising:
an oil separator connected to a discharge pipe of the compressor;
an oil tank for receiving oil from an oil sump of the oil separator;
an oil pipe disposed between the oil separator and the oil tank such that the oil pipe communicates with the oil separator and the oil tank;
a pressure reducing valve disposed on the oil pipe;
an oil supply pipe for supplying the oil to an oil line for supplying the oil to the compressor from an oil sump of the oil tank; and
an agitator disposed downstream of the pressure reducing valve and on the oil pipe communicating with the oil separator and the oil tank.

2. The oil supply system according to claim 1,
wherein the oil pipe does not include a temperature regulating device for heating or cooling the oil flowing through the oil pipe.

3. The oil supply system according to claim 1,
wherein the agitator includes a turbulator disposed in the oil pipe.

4. The oil supply system according to claim 1,
wherein the agitator includes a serpentine channel portion formed in a channel of the oil pipe.

5. The oil supply system according to claim 1, further comprising:
a liquid level sensor for detecting a liquid level of the oil stored in the oil separator; and
a control part for controlling an opening of the pressure reducing valve based on a detection value of the liquid level sensor.

6. The oil supply system according to claim 1, further comprising a gas pipe connecting a gas phase portion of the oil tank and a suction space of the compressor.

7. The oil supply system for the compressor according to claim 1,
wherein the oil supply pipe includes an oil pump.

8. The oil supply system according to claim 1,
wherein the compressor is constituted by a screw compressor, and
wherein the oil line includes at least an oil line for supplying the oil to a bearing of a screw rotor composing the screw compressor.

9. The oil supply system according to claim 1, further comprising a defoaming device for suppressing foams which are generated on a surface of the oil accumulated in the oil tank.

10. The oil supply system according to claim 1, wherein a pipe portion of the oil pipe from the pressure reducing valve to a connection end with the oil tank is horizontal or inclined downward toward a downstream side.

11. The oil supply system according to claim 1, wherein a portion of the oil pipe downstream of the pressure reducing valve has a larger channel cross-sectional area than a portion of the oil pipe upstream of the pressure reducing valve.

12. The oil supply system according to claim 1, wherein a portion of the oil pipe downstream of the pressure reducing valve is longer than half of a full length of the oil pipe.

13. The oil supply system according to claim 1, wherein the oil pipe includes a downstream end connected to the oil tank such that a flow path area of the oil flowing through the oil pipe increases at the downstream end of the oil pipe from a first area in the oil pipe to a second area in the oil tank.

14. An oil supply system for a compressor, comprising:

an oil separator connected to a discharge pipe of the compressor;

an oil tank for receiving oil from an oil sump of the oil separator;

an oil pipe disposed between the oil separator and the oil tank;

a pressure reducing valve disposed on the oil pipe;

an oil supply pipe for supplying the oil to an oil line for supplying the oil to the compressor from an oil sump of the oil tank; and an agitator disposed on the oil pipe, wherein the oil pipe is connected to a gas phase portion of the oil tank.

15. The oil supply system according to claim 14, wherein the agitator is disposed on the oil pipe downstream of the pressure reducing valve.

16. The oil supply system according to claim 14, wherein the agitator includes a spray nozzle disposed on the oil pipe and opened to the gas phase portion of the oil tank.

* * * * *